US006193527B1

(12) United States Patent
Tsai

(10) Patent No.: US 6,193,527 B1
(45) Date of Patent: Feb. 27, 2001

(54) ELECTRICAL CONNECTOR FOR A PRINTED CIRCUIT BOARD

(76) Inventor: Chou Hsuan Tsai, 15F, No. 4, Lane 127, Sec. 1, Fu-Hsing Rd., Hsin-Chuang City, Taipei Hsien (TW)

( * ) Notice: Subject to any disclaimer, the term of this patent is extended or adjusted under 35 U.S.C. 154(b) by 0 days.

(21) Appl. No.: 09/346,961

(22) Filed: Jul. 2, 1999

(30) Foreign Application Priority Data

Jul. 13, 1998 (TW) ..... 87211186

(51) Int. Cl.[7] ..... H01R 12/00
(52) U.S. Cl. ..... 439/79
(58) Field of Search ..... 439/79, 80

(56) References Cited

U.S. PATENT DOCUMENTS 4,660,911 * 4/1987 Reynolds ..... 439/80
4,860,445 * 8/1989 Jones ..... 29/842
5,827,077 * 10/1998 Fukuda ..... 439/79
5,947,754 * 9/1999 Lin ..... 439/79

* cited by examiner

*Primary Examiner*—Neil Abrams
(74) *Attorney, Agent, or Firm*—Pro-Techtor International Services

(57) ABSTRACT

An electrical connector includes a housing formed with at least one row of terminal-receiving cavities and a plurality of terminals. Each of the terminals has a horizontal terminal part which is received in a corresponding one of the cavities and a vertical terminal part which is perpendicular to the horizontal terminal part. The housing has a rear wall which is formed with a horizontally extending supporting rib that is located below the cavities and that has a free end. The vertical terminal parts of the terminals abut against the free end of the supporting ribs so as to ensure the vertical terminal parts of the terminals to be coplanar. The ribs include outer slot portions that receive vertical terminal parts and inner slot portions that receive contact protrusions.

1 Claim, 5 Drawing Sheets

ELECTRICAL CONNECTOR FOR A PRINTED CIRCUIT BOARD

BACKGROUND OF THE INVENTION

1. Field of the Invention

The present invention relates to an electrical connector, more particularly to an electrical connector having a plurality of terminals each of which has a contacting portion and an inserting portion that is substantially perpendicular to the contacting portion.

2. Description of the Related Art

FIGS. 1 and 2 show a conventional electrical connector 10 which is so-called a "Box Header Connector". The conventional electrical connector 10 includes an elongated plastic housing 100 which is formed with two rows of terminal-receiving cavities. Each of the terminal-receiving cavities of the upper row receives a contacting portion 111 of an upper row terminal 11 which has an inserting portion 112 that is substantially perpendicular to the contacting portion 111. Each of the terminal-receiving cavities of the lower row receives a contacting portion 121 of a lower row terminal 12 which has an inserting portion 122 that is substantially perpendicular to the contacting portion 121. Each of the terminals 11, 12 is solid and is square in cross-section.

The terminals 11, 12 of the conventional electrical connector 10 illustrated in FIGS. 1 and 2 have the following drawbacks:

1. The length of each of the terminals 11, 12 that extends out of the housing 100 is relatively long so that it is easy to be bent or damaged by an external force. It is especially true for the terminal 11 since the length between points a and b is much longer.

2. In order to prevent to be bent or damaged by an external force, the terminals 11, 12 must be strengthened by being solid and square in cross-section. Therefore, the manufacturing material for the terminals is increased and thus, the manufacturing cost is increased.

3. The alignment of the inserting portions 112, 122 of the terminals 11, 12 of the same row is difficult to be achieved since there is no reference point for the terminals 11, 12.

SUMMARY OF THE INVENTION

Therefore, the object of the present invention is to provide an electrical connector which can overcome the drawbacks that are associated with the prior art.

According to the present invention, an electrical connector includes a housing which is formed with at least one row of terminal-receiving cavities, and a plurality of terminals. Each of the terminals has a horizontal terminal part which is received in a corresponding one of the cavities and a vertical terminal part which is perpendicular to the horizontal terminal part. The housing has a rear wall which is formed with a horizontally extending supporting rib that is located below the cavities and that has a free end. The vertical terminal parts of the terminals abut against the free end of the supporting rib so as to ensure the vertical terminal parts of the terminals to be coplanar.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 2:
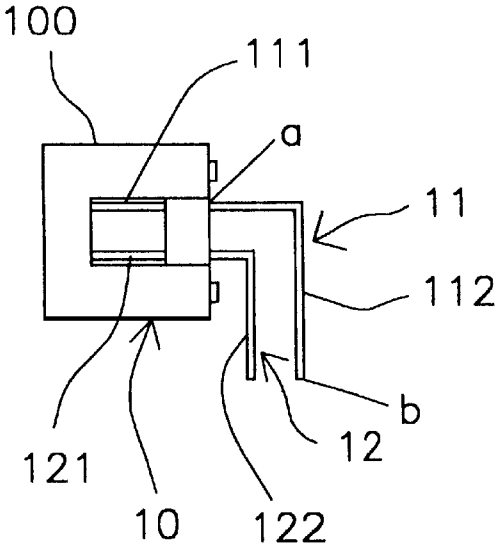
FIG. 2 (PRIOR ART)
FIG. 2 is a side view illustrating the conventional electrical connector of FIG. 1.
Figure 1:
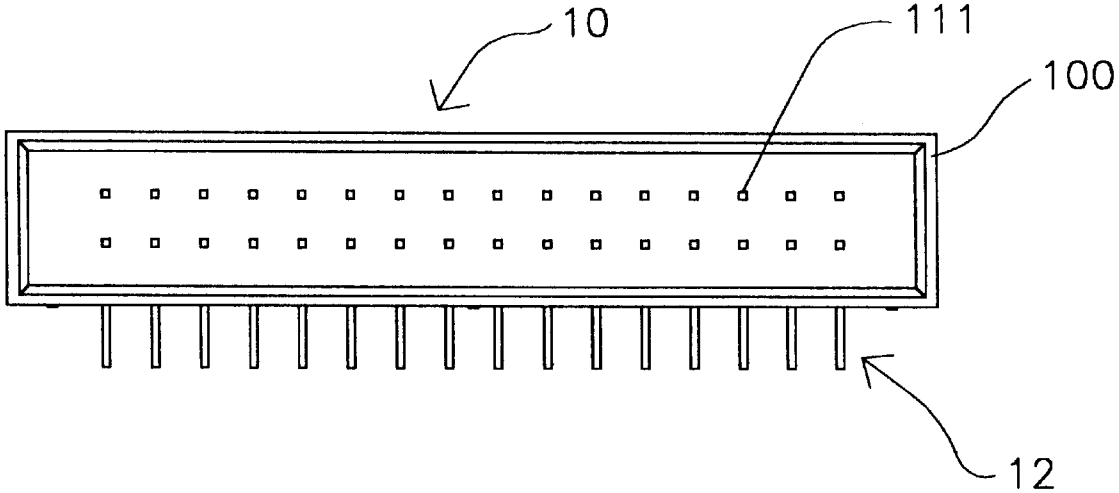
FIG. 1 (PRIOR ART)
FIG. 1 is a front view illustrating a conventional electrical connector.
Figure 3:
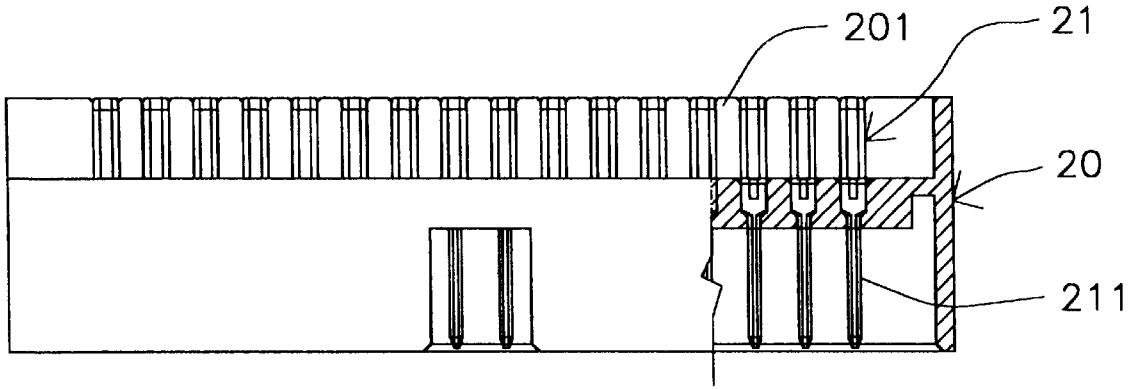
FIG. 3 is a top view of a first preferred embodiment of an electrical connector according to the present invention.
Figure 4:
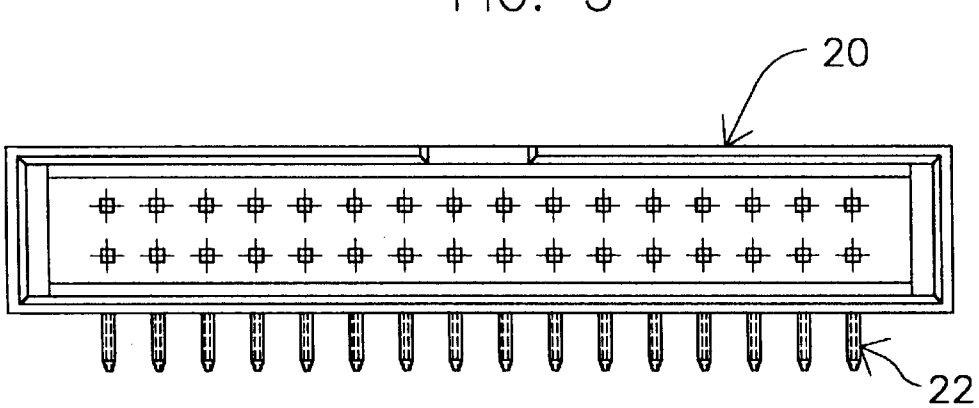
FIG. 4 is a front view of the first preferred embodiment.
Figure 5:
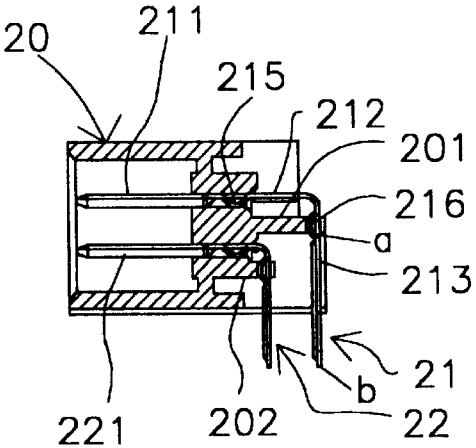
FIG. 5 is a sectional view of the first preferred embodiment.

Referring to FIGS. 3, 4 and 5, an electrical connector of a first preferred embodiment according to the present invention is shown to comprise an elongated housing 20 and two rows of terminals 21, 22. Each of the terminals 21 has a length longer than that of each of the terminals 22.

Figure 8:
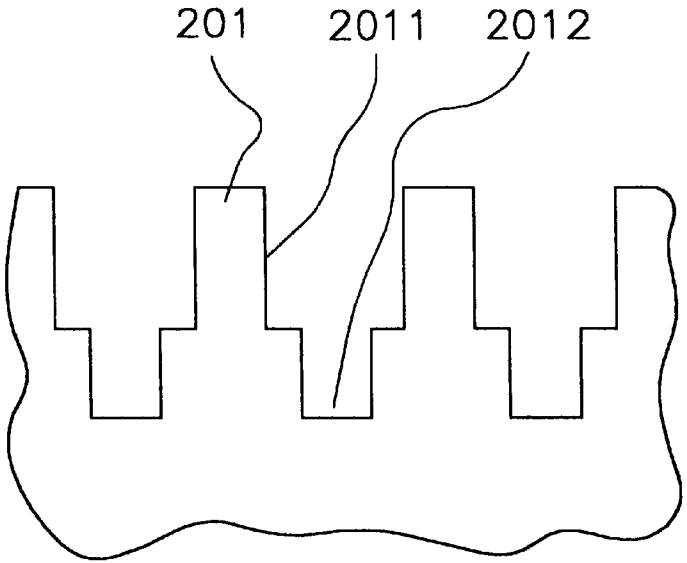
FIG. 8 is an enlarge view of a part of the first preferred embodiment.

The housing 20 has opposed front and rear walls, opposed top and bottom walls which interconnect the front and rear walls, and two rows of terminal-receiving cavities which extend between the front and rear walls. The rear wall of the housing 20 has a horizontally extending first supporting rib 201 between the two rows of terminal-receiving cavities, and a horizontally extending second supporting rib 202 between the terminal-receiving cavities of the lower row and the bottom wall of the housing 20. As best shown in FIG. 8, the first supporting rib 201 is formed with a plurality of slots between two end walls of the housing 20. Each of the slots has a wider outer slot portion 2011 and a narrower inner slot portion 2012. It should be noted that, the structure of the second supporting rib 202 is identical to that of the first supporting rib 201 so that a detailed structurally description thereof is omitted here.

Figure 6:
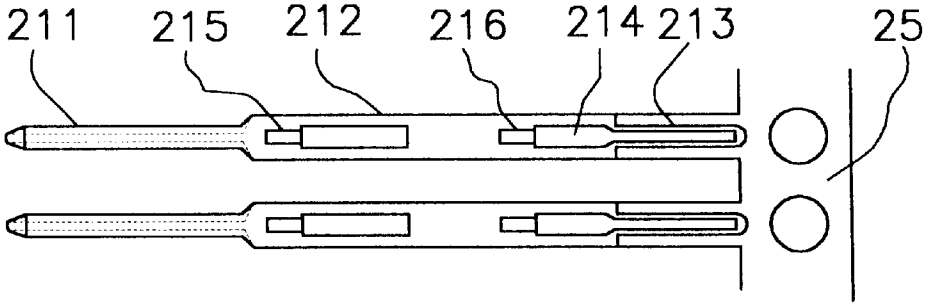
FIG. 6 is a plan view illustrating the terminals for use in the first preferred embodiment.
Figure 7:
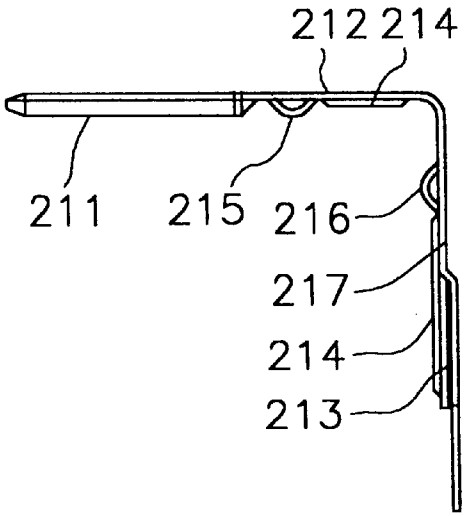
FIG. 7 is a side view illustrating one of the terminals of FIG. 6.

Referring to FIGS. 6 and 7, a plurality of terminals 21 are stamped and formed from a thin plate with a thickness of about 0.2 mm. Each of the terminals 21 has a horizontal terminal part and a vertical terminal part that is substantially perpendicular to the horizontal terminal part. The horizontal terminal part of each of the terminals 21 has a tip portion which is stamped and formed to be inverted U-shaped in cross-section and which serves as a contacting portion 211, and a tail portion which is plate in shape and which serves as a mediate portion 212. The vertical terminal part of each of the terminals 21 has a mediate portion 217 which is connected and perpendicular to the mediate portion 212 of the horizontal terminal part, and an inserting portion 213 which is connected to the mediate portion 217 and which has a width smaller than that of the mediate portion 217. Both the mediate portion 212 of the horizontal terminal part and the inserting portion 213 of the vertical terminal part are formed with a reinforcing rib 214. The mediate portion 212 of the horizontal terminal part is stamped and formed to have a protrusion 215 adjacent to the contacting portion 211. The mediate portion 217 of the vertical terminal part is also stamped and formed to have a protrusion 216 adjacent to the mediate portion 212.

The structure of the terminal 22 is identical to that of the terminal 21 but different in length. Therefore, the detailed structurally description of the terminal 22 is omitted here.

In assembled, after the terminals 21, 22 are mounted on the housing 20 with the contacting portions 211, 221 being received in the terminal-receiving cavities, the mediate portions 217 of the vertical terminal parts of the terminals 21, 22 are respectively supported by the supporting ribs 201, 202 with the mediate portions 217 received in a corresponding one of the outer slot portions 2011 and the protrusions 216 received in a corresponding one of the inner slot portions 2012, thereby ensuring the vertical terminal parts of the terminals 21 are coplanar, and ensuring the vertical terminal parts of the terminals 22 are coplanar.

The electrical connector of the first preferred embodiment described above has the following advantages:

1. The provision of the supporting ribs 201, 202 ensures the vertical terminal parts of the terminals 21, 22 of the same row to be lain on the same plane.

2. Since the terminals 21, 22 are respectively supported by the supporting ribs 201, 202, it is difficult to damage the terminals 21, 22 by an external force.

3. The housing 20 is structurally reinforced by the supporting ribs 201, 202 so that deformation thereof is not easy to occur.

4. Since the protrusions 216 of the vertical and horizontal terminal parts of the terminals 21, 22 are received in the corresponding inner slots 2012 of the supporting rib 201, 202, any undesired movement of the terminals 21, 22 relative to the housing 20 by an external force can be prevented.

Figure 10:
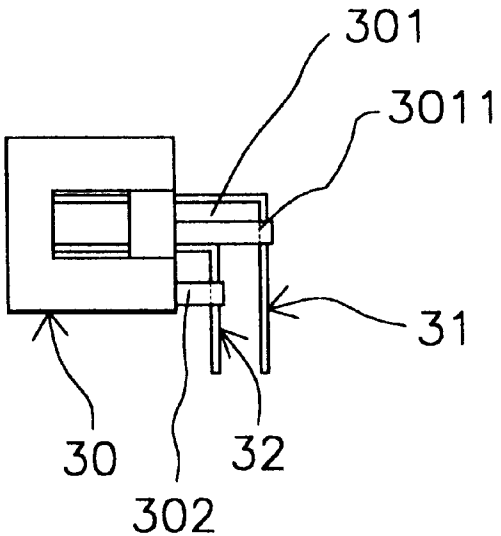
FIG. 10 is a side view of the second preferred embodiment.
Figure 9:
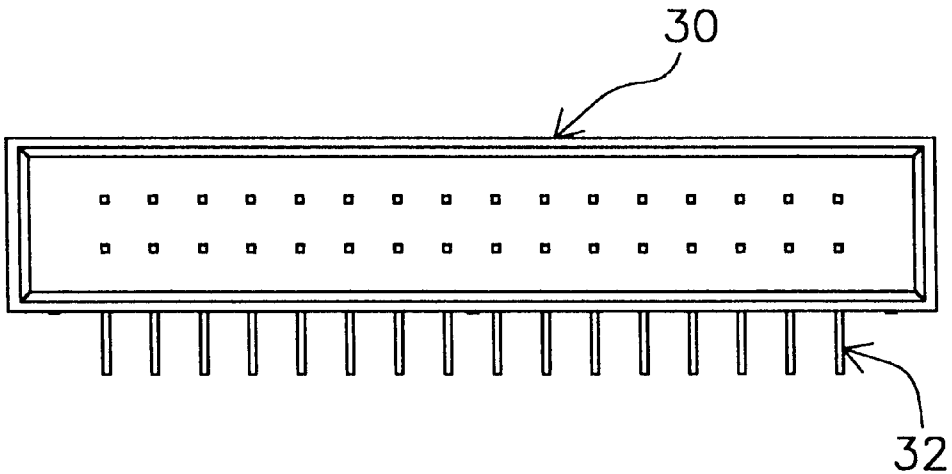
FIG. 9 is a front view of a second preferred embodiment of an electrical connector according to the present invention.

FIGS. 9 and 10 show a second preferred embodiment of the present invention. Unlike the first preferred embodiment, each of the supporting ribs 301, 302 of the housing 30 is formed with a plurality of slots 3011 between two end walls of the housing 30 for receiving a portion of the vertical terminal part of the corresponding terminal 31, 32 therein.

Figure 11:
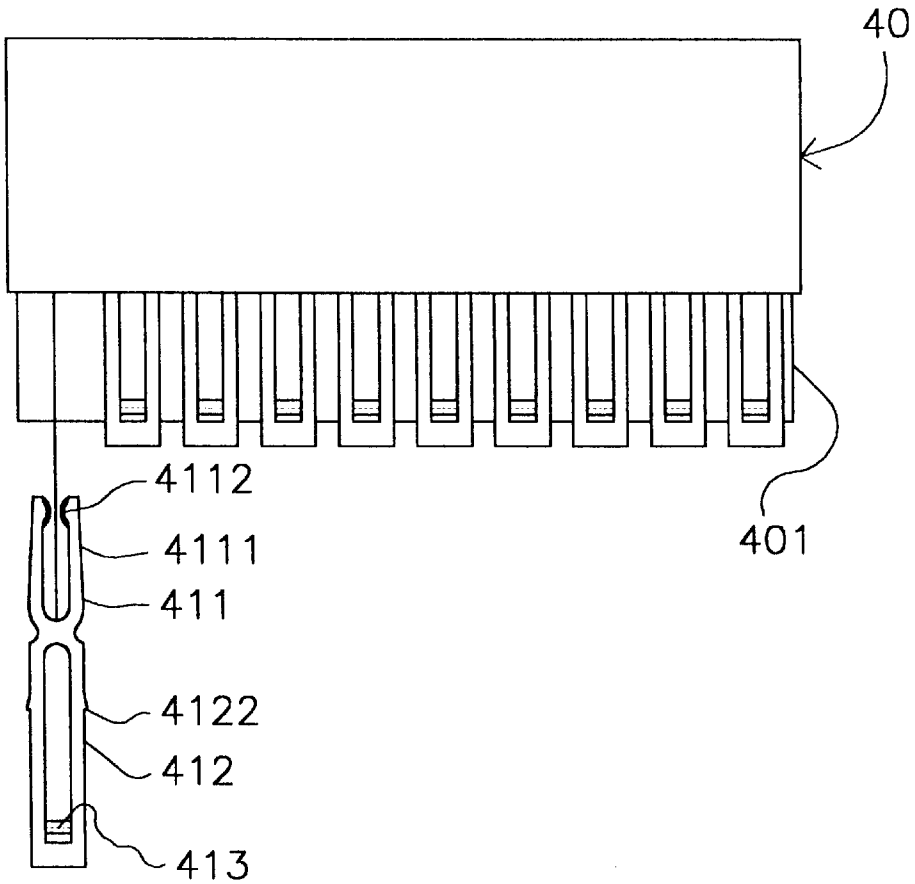
FIG. 11 is a top view of a third preferred embodiment of an electrical connector according to the present invention.
Figure 12:
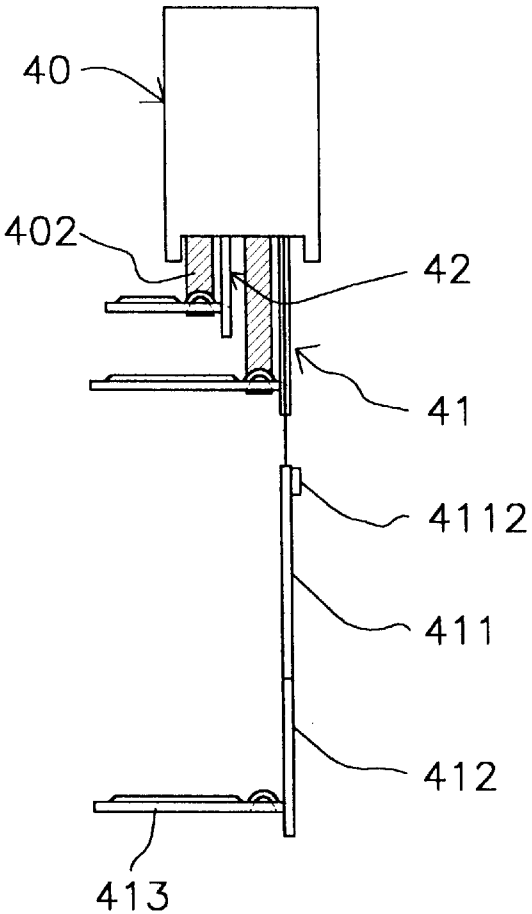
FIG. 12 is a side view of the third preferred embodiment.

FIGS. 11 and 12 show a third preferred embodiment of the present invention. Unlike the first preferred embodiment, the vertical terminal part of each of the terminals 41, 42 is stamped and formed from the mediate portion 412. The contacting portion 411 of the horizontal terminal part of each of the terminals 41, 42 has a pair of spring plates 4111. Each of the spring plates 4111 is formed with an upwardly extending rib 4112 for increasing the contacting effect. The mediate portion 412 of each of the terminals 41, 42 is formed with a pair of retention tabs 4122 at two sides thereof for preventing disengaging of the terminal 41, 42 from the housing 40.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. An electrical connector comprising:

a housing formed with at least one row of terminal-receiving cavities and a plurality of terminals, each of said terminals having a horizontal terminal part which is received in a corresponding one of the cavities and a vertical terminal part which is perpendicular to the horizontal terminal part, wherein:

said housing has a rear wall formed with a horizontally extending supporting rib located below said cavities, said vertical terminal parts of said terminals abut a free end of said supporting rib so as to ensure said vertical terminal parts of said terminals are coplanar, said vertical terminal part of each of said terminals also includes a protrusion formed thereon, said supporting rib is formed with a plurality of slots, each of said slots of said supporting rib has an outer slot portion and a more narrow inner slot portion in communication with said outer slot portion, said slots conforming exactly in shape to said vertical terminal parts, and each said slot receives a corresponding one of said vertical terminal parts, each said inner slot portion receiving said protrusion of said corresponding one of said vertical terminal parts, thereby preventing any lateral movement of said vertical terminal parts relative to said housing.

* * * * *